US006328679B1

(12) United States Patent
Croft

(10) Patent No.: US 6,328,679 B1
(45) Date of Patent: Dec. 11, 2001

(54) WALL-MOUNTABLE EXERCISE DEVICE

(76) Inventor: Ellen Croft, P.O. Box 175, Crest Park, CA (US) 92326-0175

( * ) Notice: Subject to any disclaimer, the term of this patent is extended or adjusted under 35 U.S.C. 154(b) by 0 days.

(21) Appl. No.: 09/596,868

(22) Filed: Jun. 19, 2000

(51) Int. Cl.[7] ..... A63B 21/04
(52) U.S. Cl. ..... 482/129; 482/121; 482/904
(58) Field of Search ..... 482/904, 121, 482/126, 137, 129, 112

(56) References Cited

U.S. PATENT DOCUMENTS

| | | | | |
|---|---|---|---|---|
| 2,782,033 | * | 2/1957 | Ugartechea | 482/121 |
| 4,844,448 | * | 7/1989 | Niznik | 482/40 |
| 5,320,591 | * | 6/1994 | Harmon et al. | 482/129 |
| 5,385,525 | * | 1/1995 | Davis | 482/121 |

* cited by examiner

*Primary Examiner*—Monica A. Graves
(74) *Attorney, Agent, or Firm*—Michael G. Petit

(57) ABSTRACT

A compact, low profile, wall-mountable exercise device. The device includes a modular, wall-mountable rectangular frame, a horizontal hinge rod assembly attached to the frame and rotatably mounted on the frame, a resistance bar, a pair of swing arms, each swing arm having a distal end attached to opposing ends of the hinge rod, and proximal ends attached to opposing ends of the resistance bar. The device includes at least two springs, each spring having a proximal end and a distal end. The distal ends of the springs are releasably attached to spring connectors on the frame. The proximal ends of the springs are attached to the respective swing arms near the proximal ends thereof. In use, an exerciser positions a part of his/her body, such as the hands, in contact with the resistance bar and applies a force sufficient to extend the springs. When the exerciser releases the force, the spring restores to its non-extended length. The exerciser repeats the cycle until the targeted body part(s) is sufficiently exercised. The various possible attachment points for the distal ends of the springs enable the device to be used for exercising various muscles of the body, including the arms, shoulders, legs, back, chest and abdomen. The device is inexpensive to manufacture and may be packaged in a compact, lightweight (~2 Kg) kit for storage and shipping.

1 Claim, 5 Drawing Sheets

WALL-MOUNTABLE EXERCISE DEVICE

BACKGROUND OF THE INVENTION

1. Field of the Invention

The present invention relates to exercise equipment, and more particularly, to a wall-mountable resistance device for personal exercise.

2. Prior Art

Wall-mountable resistance-type exercise devices are well known in the art. Various embodiments of such devices are disclosed, for example, in U.S. Pat. Nos. 5,468,205, 5,431,617, 4,402,504 and 5,385,525. Little, in U.S. Pat. No. 5,626,546, the contents of which patent is incorporated herein by reference thereto, provides a review of such prior art devices and discloses a wall-mountable resistance-type exercise device that overcomes many of the limitations present in prior art devices. Little's device has a matched pair of slotted rails adapted to be vertically mounted on a vertical surface. A matched pair of swing arms are rotatably mounted on slidably adjustable universal blocks disposed within the slots. The opposing ends of the swing arms are attached to a resistance bar and an elastic resistance member. The points of attachment of both the swing arms and the elastic resistance members to the slotted rails are incrementally adjustable along substantially the entire length of the slotted rails. A disadvantage of the device is the large number of parts required to make the device operational. There is, therefore, a need for a versatile wall-mountable resistance-type exercise device that is quickly and easily assembled and requires few parts for operation.

SUMMARY

A first object of the present invention is to provide a wall-mountable resistance-type exercise device that can be rapidly assembled and installed with a minimum of parts.

It is a further object of the present invention is to provide a wall-mountable resistance-type exercise device that can be used by an exerciser in either a standing, sitting or supine position.

It is yet a further object of the invention to provide a wall-mountable resistance-type exercise device that employs springs as a resistance element.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
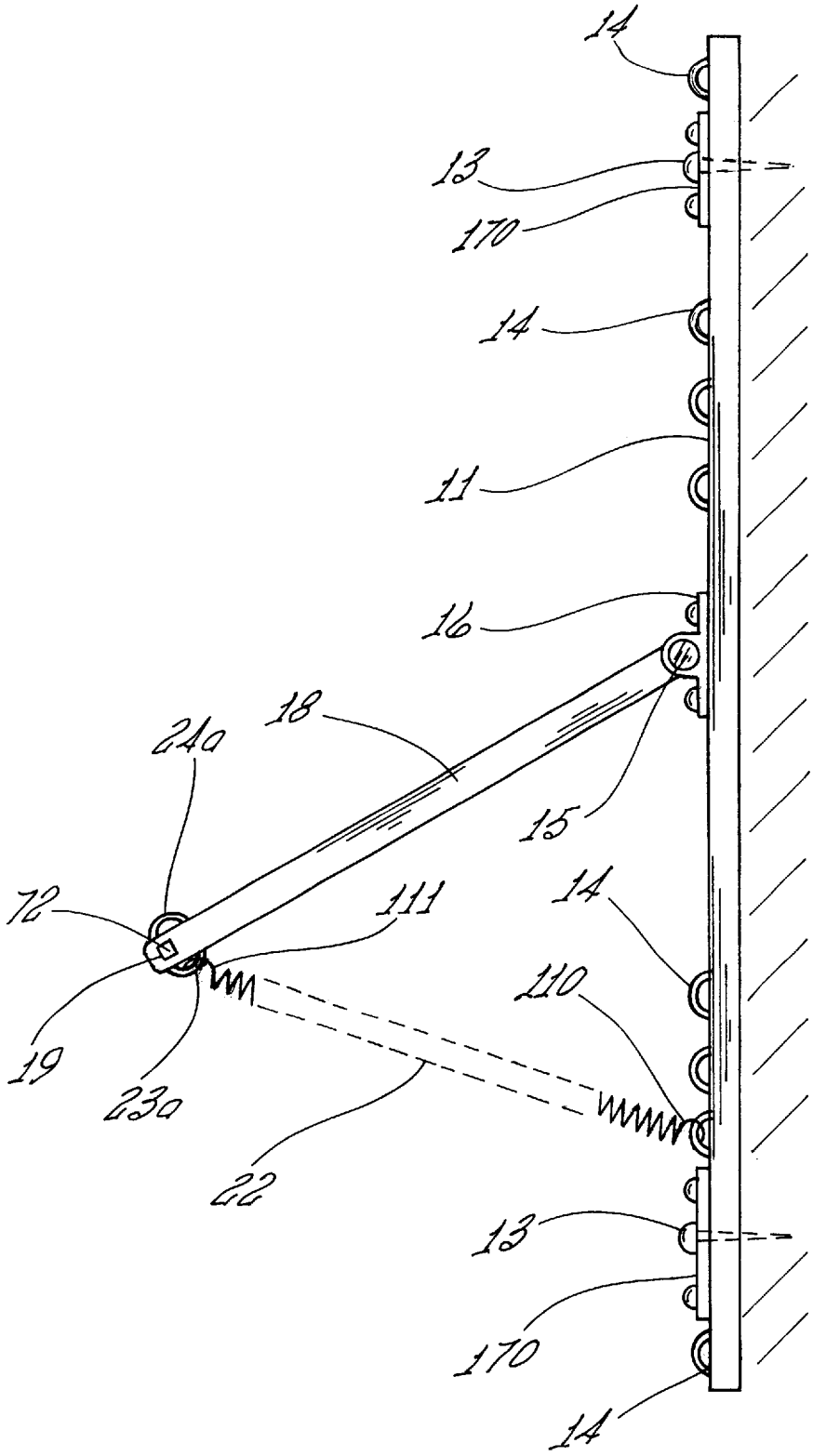
FIG. 1 is a side view of a wall-mounted exercise device in accordance with the present invention.
Figure 2:
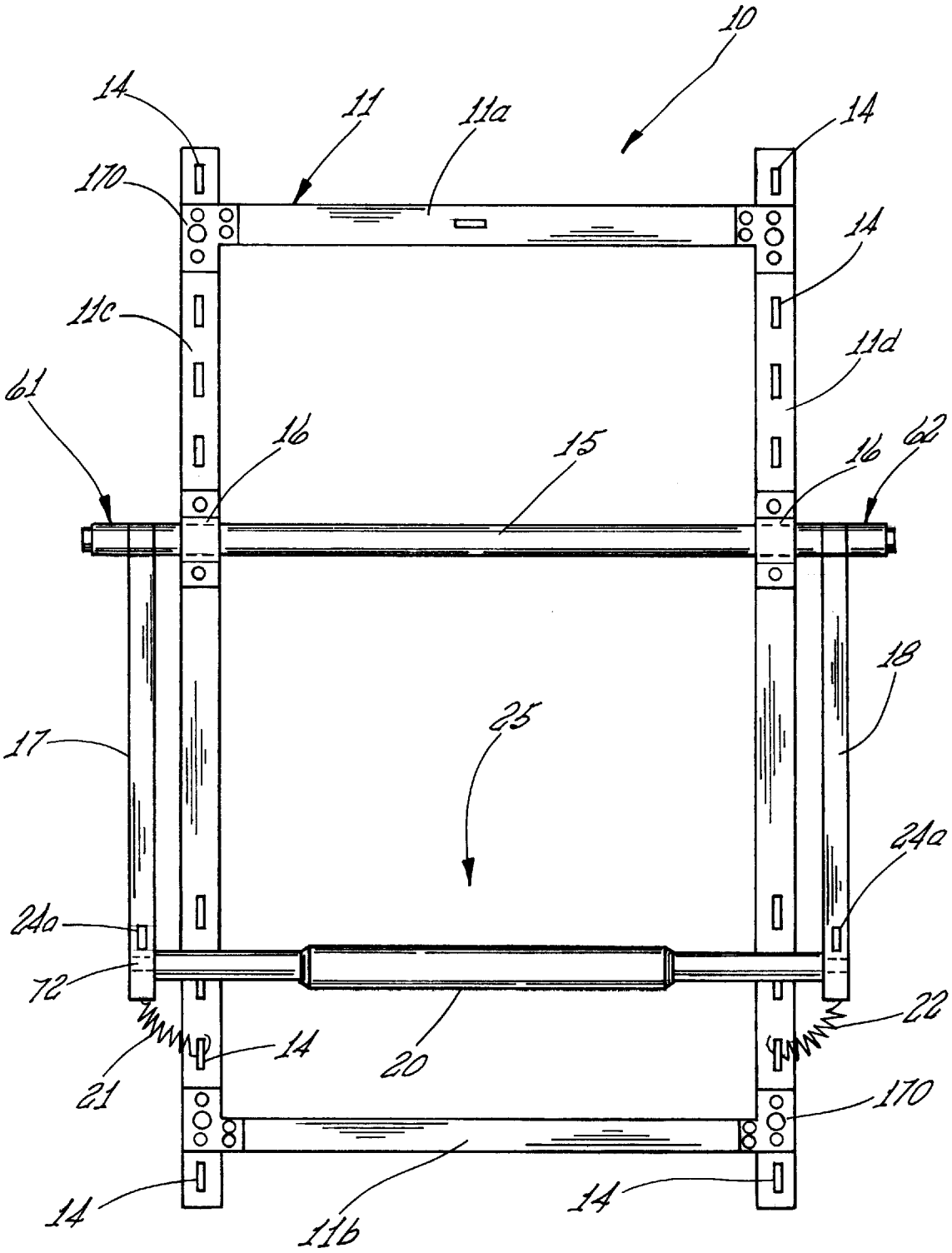
FIG. 2 is a front view of the wall-mounted exercise device of the present invention with the springs removed.
Figure 6:
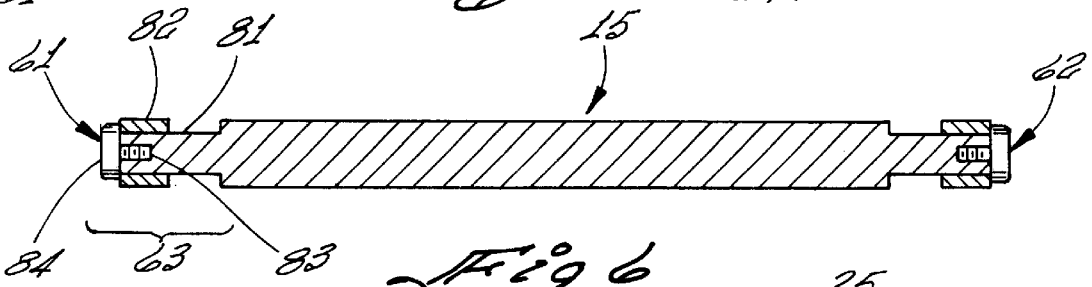
FIG. 6 is a cross-sectional view of the hinge bar assembly.
Figure 7:
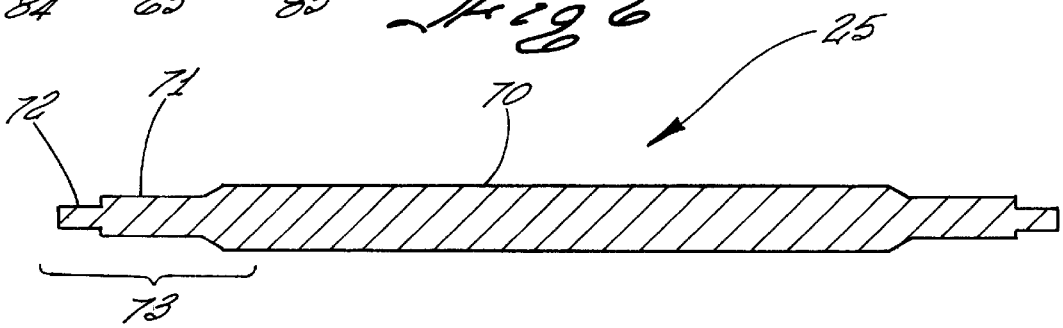
FIG. 7 is a cross-sectional view illustrating the resistance bar assembly.

Turning first to FIGS. 1 and 2, a preferred embodiment of an exercise device in accordance with the present invention is generally indicated at numeral 10. The device 10 includes a rectangular frame 11 attached to a wall 12 by frame mounting means 13 such as, for example, screws. The frame 11 includes a plurality of spaced spring attachment loops 14 integral therewith. A transversely oriented hinge bar 15 is rotatably attached to the frame by a pair of hinge bar mounting brackets 16 affixed to the frame 11. The hinge bar 15 has left and right ends, labeled 61 and 62 in FIG. 6, extending laterally from the hinge bar mounting brackets 16.

The device 10 includes a left swing arm 17 (not visible in FIG. 1) and a right swing arm 18. A distal end of both swing arms are rotatably attached to the respective left and right ends 61 and 62 of the hinge bar 15. The opposing, proximal ends of the left and right swing arms are non-rotatably attached to left and right ends of a resistance bar 25 which provides a gripping surface for an exerciser's hands. Resistance to motion of the resistance bar is provided by left and right extensible springs 21 (not visible in FIG. 1) and 22. A distal end of the springs include a hook 110 thereon which releasably engages one of the plurality of spring attachment loops 14 on the frame. A hook 111 on the proximal ends of the respective springs releasably engages one of the spring attachment loops 23*a*, 23*b*, 24*a* or 24*b* disposed on the proximal ends of the respective swing arms.

Figure 3:
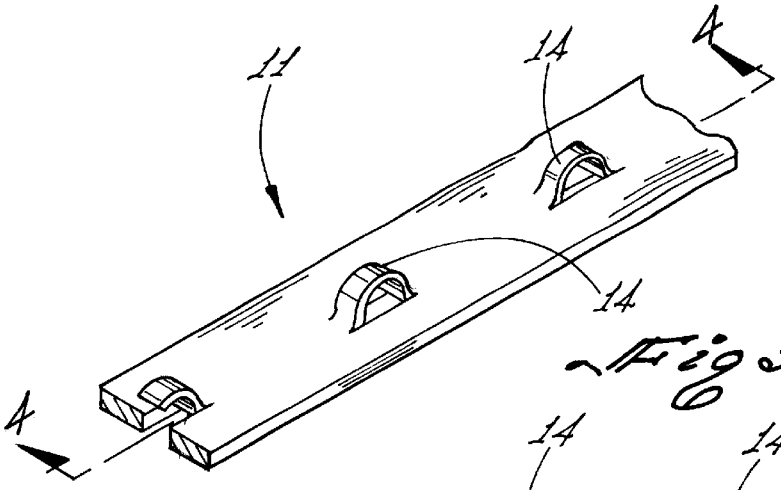
FIG. 3 is an enlarged perspective view of a portion of the wall-mountable frame of the present invention illustrating the unitary spring attachment means disposed on a section of the frame.
Figure 4:
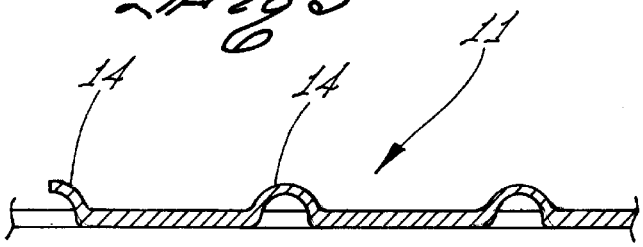
FIG. 4 is a side cross-sectional view of the portion of frame shown in FIG. 3 viewed along section line 4—4.

An important feature of the present invention is that the device 10 has fewer separable parts than the prior art devices and the modular construction permits shipping the device as a kit that is easily assembled. The frame 11 comprises an upper horizontal member 11*a*, a lower horizontal member 11*b*, a left vertical member 11*c* and a right vertical member 11*d*. The four members comprising the frame preferably have mitered corners and are affixed to one another by frame attachment plates 170 to form a rectangle as shown in FIG. 2. The overall dimensions of the frame 11 are 47 inches high and 18.5 inches wide. The four members comprising the frame and the four frame attachment plates are most preferably aluminum. A plurality of spring attachment loops 14 are disposed along the length of the vertical members 11*c* and 11*d* and spaced from one another by a distance of about 3 inches. The spring attachment loops 14 are integral with the frame 11 and are made by die punching the wall of the vertical members to cut two slots and stretching the material between the slots outwardly to form a loop. The spring attachment loops 14 thus formed in one of the members 11*a–d* comprising the frame 11 are illustrated in perspective view in FIG. 3 and cross-sectional view in FIG. 4.

Figure 5:
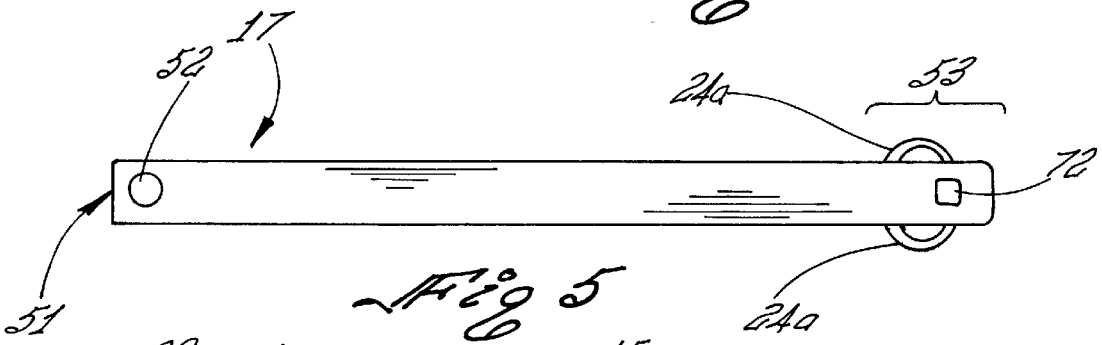
FIG. 5 is a side elevational view of a swing bar.
Figure 8:
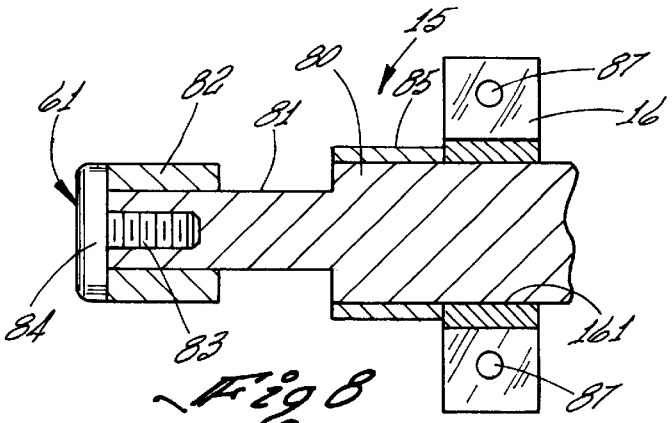
FIG. 8 is an enlarged cross-sectional view of a portion of the left end of the hinge bar indicated at 63 in FIG. 6, the right end of the hinge bar being a mirror image thereof.
Figure 9:
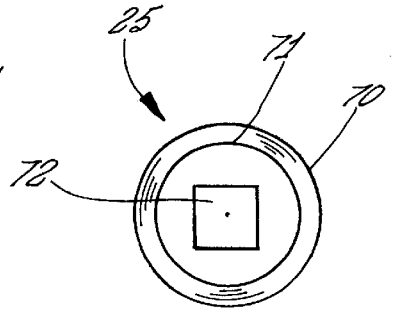
FIG. 9 is an end view of a portion of the left end of the resistance bar indicated at 73 in FIG. 7, the right end of the resistance bar being a mirror image thereof.
Figure 10:
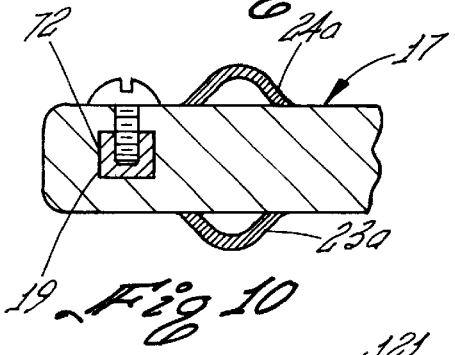
FIG. 10 is a cross-sectional view of the proximal end of a right swing bar attached to the resistance bar, the left swing bar being a mirror image thereof
Figure 11:
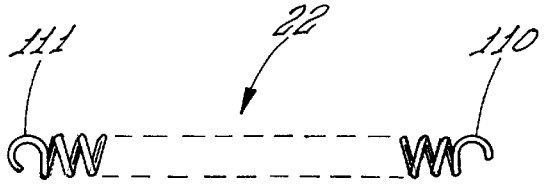
FIG. 11 is an elevational view of a spring adapted for attachment to spring attachment loops on the proximal end of the swing arms and the frame.
Figure 15:
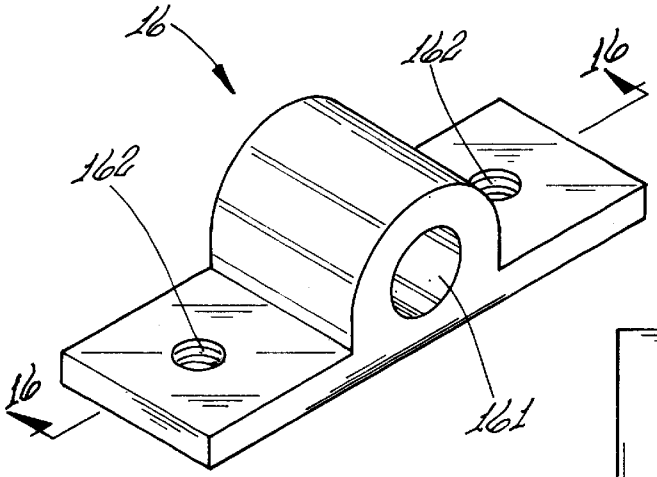
FIG. 15 is a perspective view of a hinge bar mounting bracket.
Figure 16:
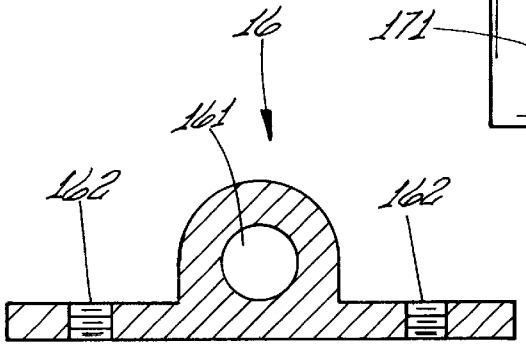
FIG. 16 is a cross-sectional view of the hinge bar mounting bracket shown in FIG. 15 taken along section line 16—16.

Turning now to FIG. 5, a swing arm is illustrated in longitudinal elevational view. The swing arm 17 has a distal end 51 with a transverse bore 52 therein, and a proximal end 53 having a square transverse bore 54 therethrough and upper and lower spring attachment loops 24*a* and 23*a* respectively attached thereto, as, for example, with a welded joint. The left and right swing arms are identical and preferably made from a rigid material and have a length of about 24 inches. The hinge bar assembly 15 is shown in longitudinal cross-sectional view in FIG. 6, with the cross-sectional detail of the end 63 of the hinge bar assembly and hinge bar mounting bracket illustrated in FIG. 8. Both the hinge bar and the resistance bar have left and right ends that are mirror images of each other. Hence, while only one end of each member will be discussed in detail below, it is understood that the opposing end of the member is a mirror image thereof. The hinge bar 15, which is preferably made from steel, has a cylindrical center portion 80 and a cylindrical end portion 81 projecting laterally therefrom, the end portion 81 having a smaller diameter than the diameter of the center portion. The diameter of the cylindrical portion 80 of the hinge bar 15 is dimensioned to rotate snugly within the bore 161 in the hinge bar mounting brackets 16 (FIGS. 15 and 16). During assembly of the device 10, the end portion 81 and a portion of the cylindrical portion 80 adjacent to the end portion is inserted into the bore 161 of the hinge bar mounting bracket 16. A bushing 85 is placed over the cylindrical portion 80 and positioned between the end portion and the hinge bar mounting bracket 16. Next, the end portion is inserted through the bore 52 on the distal end of the swing arm and a second bushing 82 inserted over the end portion and secured by means of a machine screw 84 which is screwed into a threaded axial bore 83 in the end portion 81. The square ends 72 (shown in end view in FIG. 6) on the resistance bar 25 are inserted into the mating holes 19 in the proximal end of the swing arms and fastened thereto by machine screws 72 as shown in FIG. 10. After the hinge bar, swing arms and resistance bar subassembly is constructed, the hinge bar mounting brackets 16 are attached to the vertical members 11*c* and 11*d* of the frame 11 with machine screws (not shown) inserted through holes 87 in the hinge bar mounting bracket. A hook 11 (FIG. 1l) on the proximal end of the springs 22 is releasably attached to spring attachment loop 23*a* or 24*a* on the proximal end of the swing arms and a second hook 112 attached to one of the hook attachment loops 14 on the frame. The exercise device is assembled and ready for use.

In operation, an exerciser places a targeted portion of the body in contact with the resistance bar and exerts a force on the resistance bar sufficient to move the resistance bar thereby extending the spring against a restoring force. The force required to displace the resistance bar and extend the spring is substantially constand over the range of motion. The resistance bar is then allowed to return to its initial position and the motion repeated until the targeted body portion is sufficiently exercised. The selection of spring attachment hooks 14 on the frame that are available to the exerciser for anchoring the distal hook 110 of the spring makes it possible to exercise a variety of muscles within the body.

Figure 12:
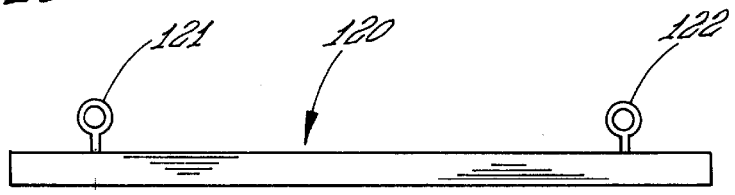
FIG. 12 is an elevational view of a wooden dowel used to replace the resistance bar and swing arm for performing certain exercises.
Figure 13:
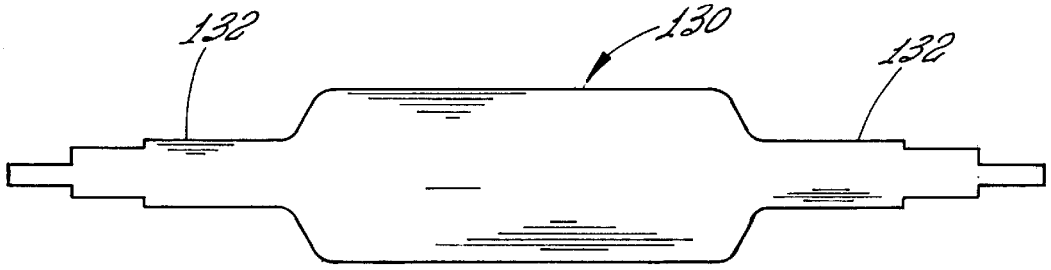
FIG. 13 is a top view of a foot plate adapted to replace the resistance bar for performing certain leg exercises.

For certain exercises, the exerciser may prefer to attach a wooden dowel 120, shown in FIG. 12, to the frame 11 by means of the springs 22 attached to eye-bolts 121 and 122 on the dowel. This enables the dowel (resistance bar) to be extended farther from the frame than is possible with resistance bar 25, the travel of the latter being constrained to move in an arc having a radius defined by the length of the swing arms. A foot plate 130 may be disposed either over the resistance bar 25, or used separately, replacing the resistance bar, to provide a flat surface against the feet may be placed when exercising leg muscles. The foot plate 130 preferably has a flattened center portion 131 providing a surface against which the feet may exert pressure, and round ends 132 extending laterally from the flattened central portion which provide a contoured surface that can be comfortably and securely gripped.

Figure 14:
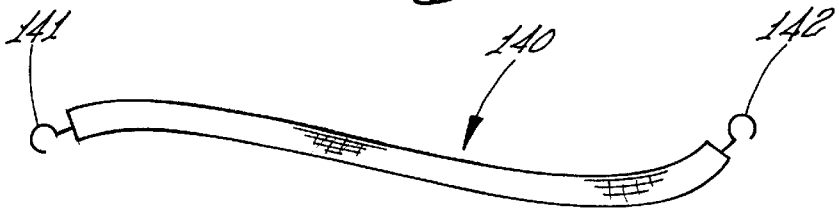
FIG. 14 is a perspective view of a length of webbing for attachment between the swing ark and frame to prevent the resistance bar from injuring the exerciser during the performance of certain exercises.
Figure 17:
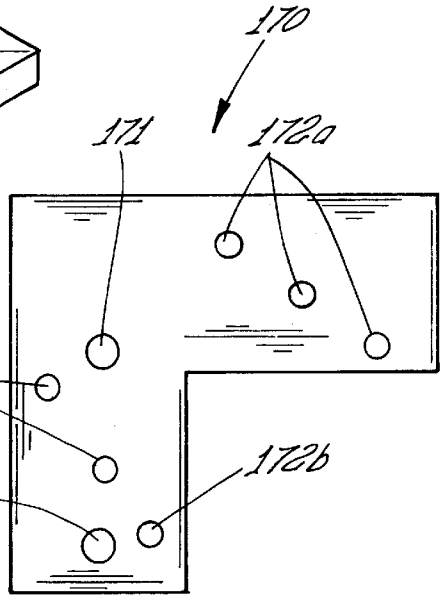
FIG. 17 is a top view of a frame attachment plate.

If the distal end of the springs is attached to the frame at a point below the hinge bar and the exerciser is positioned below the resistance bar to provide an upward force thereagainst, as, for example, lying on the floor, if the exerciser loses the grip on the resistance bar it will release downwardly with possible injury for the exerciser. A non-extensible webbing 140, shown in FIG. 14, having hooks 141 and 142 thereon, can be attached to the resistance bar and a spring attachment hook on the frame to limit the downward travel of the resistance bar. Four frame attachment plates 170 (FIG. 17) are used to secure the frame members 11*a–d* in a rectangular configuration by means of machine screw holes 172. Holes 171 are used to secure the frame to the wall.

Figure 18:
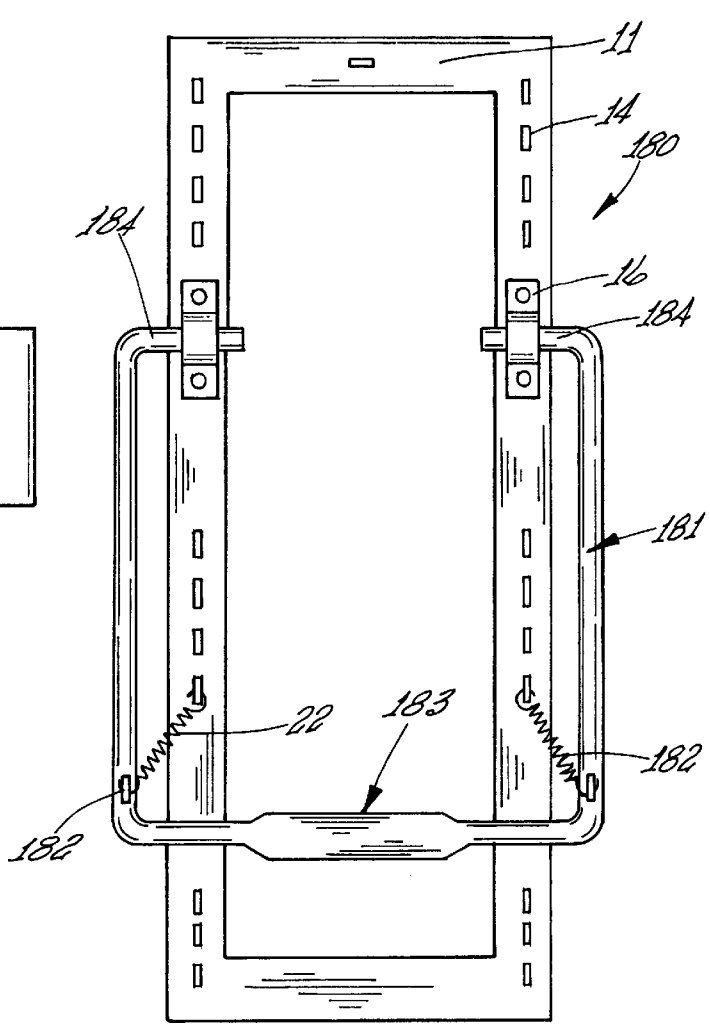
FIG. 18 is a front view of a second embodiment of the present invention.

The wall-mountable exercise device described above, while having fewer parts than prior art devices, can be simplified even further. An embodiment of such a further-simplified, wall-mountable exercise device in accordance with the present invention is shown at numeral 180 in FIG. 18. In the embodiment 180, the frame 11 is of unitary construction and is preferable made of ⅛–¼ inch aluminum plate. The hinge bar, swing arms and resistance bar are incorporated into a single unitary, substantially U-shaped resistance member 181 that is rotatably attached to the frame 11 at two distal ends 184. The unitary resistance member 181, which has at least two spring attachment loops 182 integral therewith adjacent a resistance bar portion 183, is preferably extruded aluminum rod or tubing formed into a U-shape by bending the extruded member around a mandrel to the desired shape. In the embodiment 180, the hinge bar mounting brackets 16 preferably include roller bearings press-fitted into the bore 161 to reduce wear on the moving surfaces. Embodiment 180 has six separable parts: a unitary frame 11, a unitary resistance member 181, two hinge bar mounting brackets 16 and two springs 22. Further accessories for the exercise devices 10 and/or 180 include a platform (not shown) for exerciser height compensation and/or a mat (also not shown) for the comfort of the exercisor when in a supine position. In addition, foot rings (not shown) may be attached to the hooks on the proximal ends of the springs for exercising the legs.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A well-mounted resistance-type exercise device comprising (a) a rectangular wall-mountable frame having upper and lower horizontal members and left and right vertical members;

(b) a left hinge bar mounting bracket integral with said right vertical member of said frame;

(c) a right hinge bar mounting bracket intergral with said right vertical member of said frame;

(d) a plurality of spring attachment loops integral with said vertical members of said frame, said plurality of spring attachement loops including loops disposed both above and below said left hinge bar mounting bracket and said right hinge bar mounting bracket and spaced from each other by an interlope distance;

(e) a hinge bar having a left end rotatably attached to said left vertical member by said left hinge bar mounting bracket and a right end rotatably attached to said right vertical member by said right hinge bar mounting bracket;

(f) a left swing arm having a distal end rotatably attached to said left end of said hinge bar and a proximal end with at least one spring attachment loop integral therewith and disposed at said proximal end;

(g) a right swing arm having a distal end rotatably attached to said right end of said hinge bar and a proximal end with a least one spring attachment loop integral therewith and disposed adjacent said proximal end;

(h) a resistance bar having a left end attached to said proximal end of said left swing arm, and a right end attached to said proximal end of said right swing arm;

(i) two substantially identical springs, each spring having a proximal end and a distal end with hooks thereon, said hooks being operable for releasably engaging said spring attachment loops on said frame and on said swing arms.

* * * * *